US008424851B2

(12) United States Patent
Christoffer et al.

(10) Patent No.: US 8,424,851 B2
(45) Date of Patent: Apr. 23, 2013

(54) METAL SAFETY RAIL FOR OPEN FLOORS OF A BUILDING UNDER CONSTRUCTION

(76) Inventors: Alfred C. Christoffer, Barrington, IL (US); Steve M. Stawychny, Chicago, IL (US)

( * ) Notice: Subject to any disclaimer, the term of this patent is extended or adjusted under 35 U.S.C. 154(b) by 94 days.

(21) Appl. No.: 12/460,754

(22) Filed: Jul. 24, 2009

(65) Prior Publication Data

US 2011/0017968 A1 Jan. 27, 2011

(51) Int. Cl.
*E04H 17/20* (2006.01)

(52) U.S. Cl.
USPC ..... 256/65.14; 256/59

(58) Field of Classification Search ..... 256/DIG. 6, 256/27, 60, 65.14; 52/DIG. 12; 182/113
See application file for complete search history.

(56) References Cited

U.S. PATENT DOCUMENTS

| | | | | |
|---|---|---|---|---|
| 3,020,023 | A * | 2/1962 | MacIntyre et al. | 256/24 |
| 3,420,013 | A * | 1/1969 | Alvarado | 52/161 |
| 3,881,698 | A * | 5/1975 | Marsh | 256/59 |
| 5,161,784 | A * | 11/1992 | Sader | 256/24 |
| 5,182,889 | A * | 2/1993 | Johnson | 52/298 |
| 5,312,089 | A * | 5/1994 | Venegas, Jr. | 256/65.12 |
| 5,527,016 | A * | 6/1996 | Wilkerson, Jr. | 256/67 |
| 6,015,139 | A * | 1/2000 | Weber | 256/65.14 |
| 6,540,209 | B2 * | 4/2003 | Ross | 256/68 |
| 6,554,257 | B1 * | 4/2003 | Kenton | 256/24 |
| 6,679,482 | B2 * | 1/2004 | Allenbaugh | 256/65.14 |
| 7,338,033 | B2 * | 3/2008 | Anson et al. | 256/65.14 |

* cited by examiner

*Primary Examiner* — Joshua Kennedy
(74) *Attorney, Agent, or Firm* — Donald Flaynik

(57) ABSTRACT

A metal safety rail for open floors of a building under construction includes a baseplate secured to a floor surface, a substantially vertical inner stanchion integrally joined to the baseplate, a substantially vertical outer stanchion slidably disposed over the inner stanchion, and at least one guard member secured to adjacent outer stanchions, whereby a safety rail is ultimately disposed about a peripheral portion of an open floor of a building under construction to prevent workers from falling from the open floor to the ground below.

24 Claims, 20 Drawing Sheets

METAL SAFETY RAIL FOR OPEN FLOORS OF A BUILDING UNDER CONSTRUCTION

BACKGROUND OF THE INVENTION

1. Field of the Invention

The present invention relates generally to safety rails or guard rails for open air floors of buildings under construction and, more particularly, to metal safety rails that are reusable.

2. Background of the Prior Art

Safety rails used to prevent workers from falling from open floors of buildings under construction are generally fabricated from wood that is secured together with nails. The wooden safety rails is ultimately "destroyed" when the wooden safety rail is removed from the installation location. Further, the process of assembling and disassembling the wooden safety rail is labor intensive, time consuming and expensive.

After the work is completed for the respective open floor, the wooden safety rails are torn apart and discarded, and the respective floor is enclosed. New lumber is then required for constructing safety rails for the next open floor of the building. The discarded wood ultimately ends up in a landfill. The new lumber for the next safety rail must be measured, cut and installed in the same labor intensive, time consuming manner. The new lumber is ultimately discarded when the work is complete for the respective floor. The process is repeated until the building is completed.

A need exists for a metal safety rail that is reusable, that quickly assembles and disassembles, that disassembles into two separate members to prevent cooperating elements from being lost or damaged, and that is more stabile, force resistant and safer than comparable wooden safety rails. Further, the metal safety rail must meet all specifications established by safety agencies.

SUMMARY OF THE INVENTION

A principle object of the present invention is to provide a metal safety rail for open floors of a building under construction. A feature of the safety rail is a metal baseplate secured to a floor surface via anchor bolts. Another feature of the safety rail is a pair of inner stanchions welded to the baseplate, each inner stanchion slidably receiving cooperating outer stanchions of two discrete rail sections. An advantage of the safety rail is that the metal baseplate and inner stanchions maintain the position of the safety rail upon a floor portion when typical force magnitudes are imparted upon safety rails. Another advantage of the safety rail is that the metal baseplate is detachable from the floor surface thereby allowing the safety rail to be reused.

Another object of the present invention is to provide a metal safety rail that is easily and quickly assembled and disassembled. A feature of the safety rail is a plurality of metal rail sections that include two integral metal outer stanchions that snugly slide over cooperating inner stanchions integrally joined to adjacent baseplates. An advantage of the safety rail is that labor costs are reduced. Another advantage of the safety rail is that the safety rail is reusable. Still another advantage of the safety rail is that no portions of the safety rail are discarded.

Yet another object of the present invention is to maintain safety for personnel engaging the safety rail. A feature of the safety rail is a rod or joining member that secures the outer stanchion to the inner stanchion. An advantage of the safety rail is that a rail section cannot be lifted from the inner stanchions, thereby exposing individuals to a dangerous fall from the open floor under construction. Another advantage of the safety rail is that the joining member is quickly secured to and removed from the inner, thereby minimizing time and costs to assemble and disassemble the safety rail.

Still another object of the present invention is to prevent joining members from being lost or damaged. A feature of the safety rail is a sleeve joined to an outer stanchion, the sleeve slidably receiving the joining member. Another feature of the safety rail is a washer welded to the joining member such that the washer and the sleeve cooperate to maintain the joining member inside the outer stanchion. An advantage of the safety rail is that two joining members remain with each rail section, thereby preventing lost or damaged joining members and reducing the time required to secure and separate rail sections and inner stanchions.

Another object of the present invention is to allow the safety rail to be vertically adjustable when varying elevations are required to prevent personnel or materials from falling from an open floor of a building under construction. A feature of the safety rail is a coupling member disposed between portions of the inner and outer stanchions as each rail section is elevated. An advantage of the safety rail is that the coupling member occupies "space" between the inner and outer stanchions, thereby increasing safety rail stability and resistance to forces imparted upon one or more rail sections forming the safety rail.

Briefly, the invention provides a safety rail for open floors of a building under construction comprising a baseplate secured to a floor surface; an inner substantially vertical stanchion integrally joined to said baseplate; an outer substantially vertical stanchion slidably disposed over said inner stanchion; at least one guard member secured to adjacent outer stanchions; and means for removably securing said outer stanchion to said inner stanchion, whereby a plurality of baseplates, inner stanchions, outer stanchions and guard rails are ultimately joined together to form a safety rail disposed about a peripheral portion of an open floor of a building under construction, thereby preventing workers from falling from a floor of the building under construction to the ground below.

The invention further provides a reusable safety rail for open floors of a building under construction comprising an inner stanchion secured to a floor portion of a building under construction; an outer stanchion disposed upon and rigidly and detachably secured to said inner stanchion; and multiple guard members removably secured to said outer stanchion, whereby a safety rail is constructed that prevents working personnel from falling from a floor of an open building under construction.

The invention also provides a method for construction a guard rail on floors of a building during construction, said method comprising the steps of securing an inner stanchion to a floor portion of a building under construction; disposing an outer stanchion upon said inner stanchion; rigidly and removably securing said outer stanchion to said inner stanchion; and removably securing guard members to adjacent outer stanchions, whereby a height adjustable guard rail is constructed for preventing workers from falling from an elevated floor portion.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
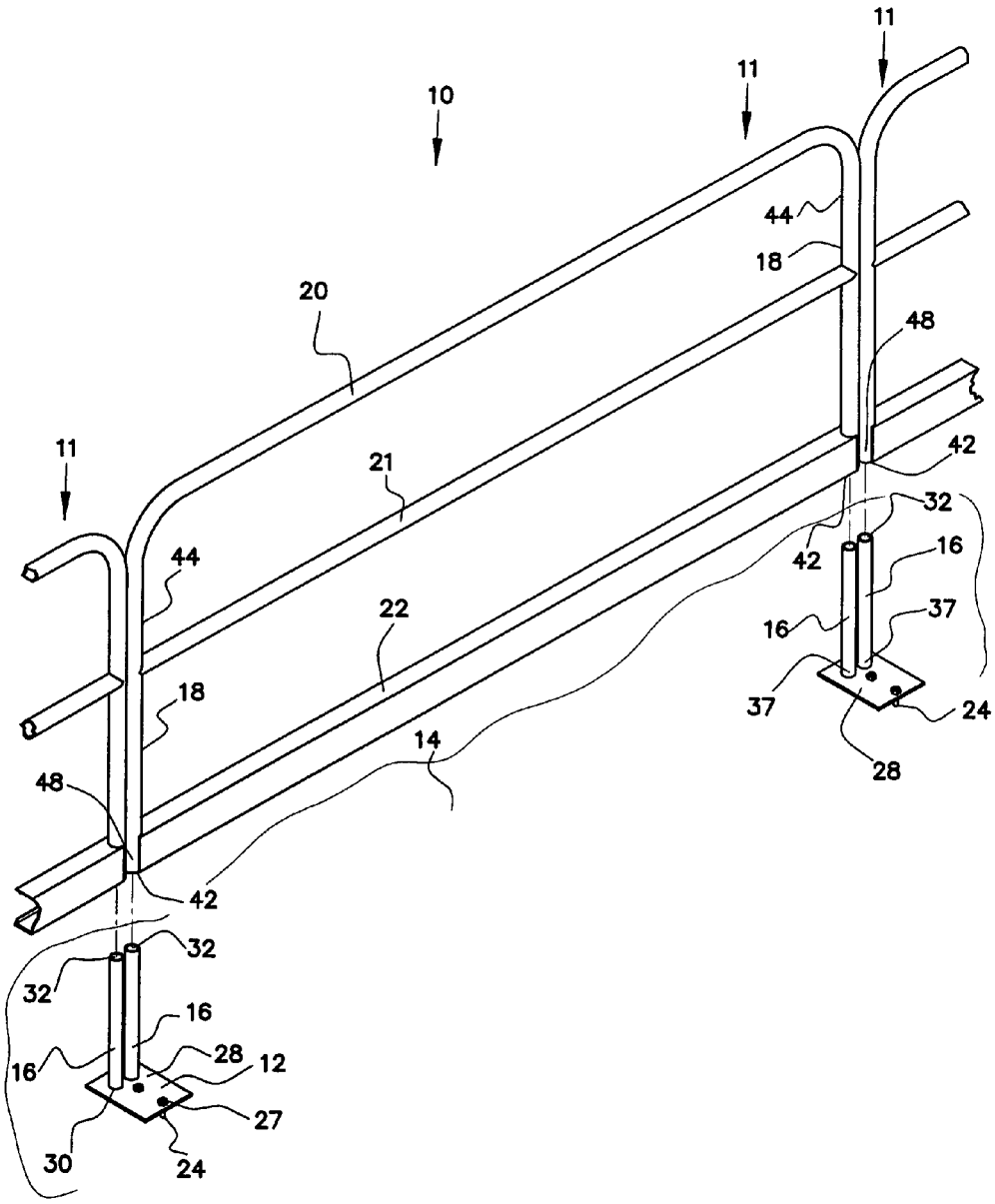
FIG. 1 is a perspective view of a safety rail for open floors of a building under construction in accordance with the present invention.
Figure 2:
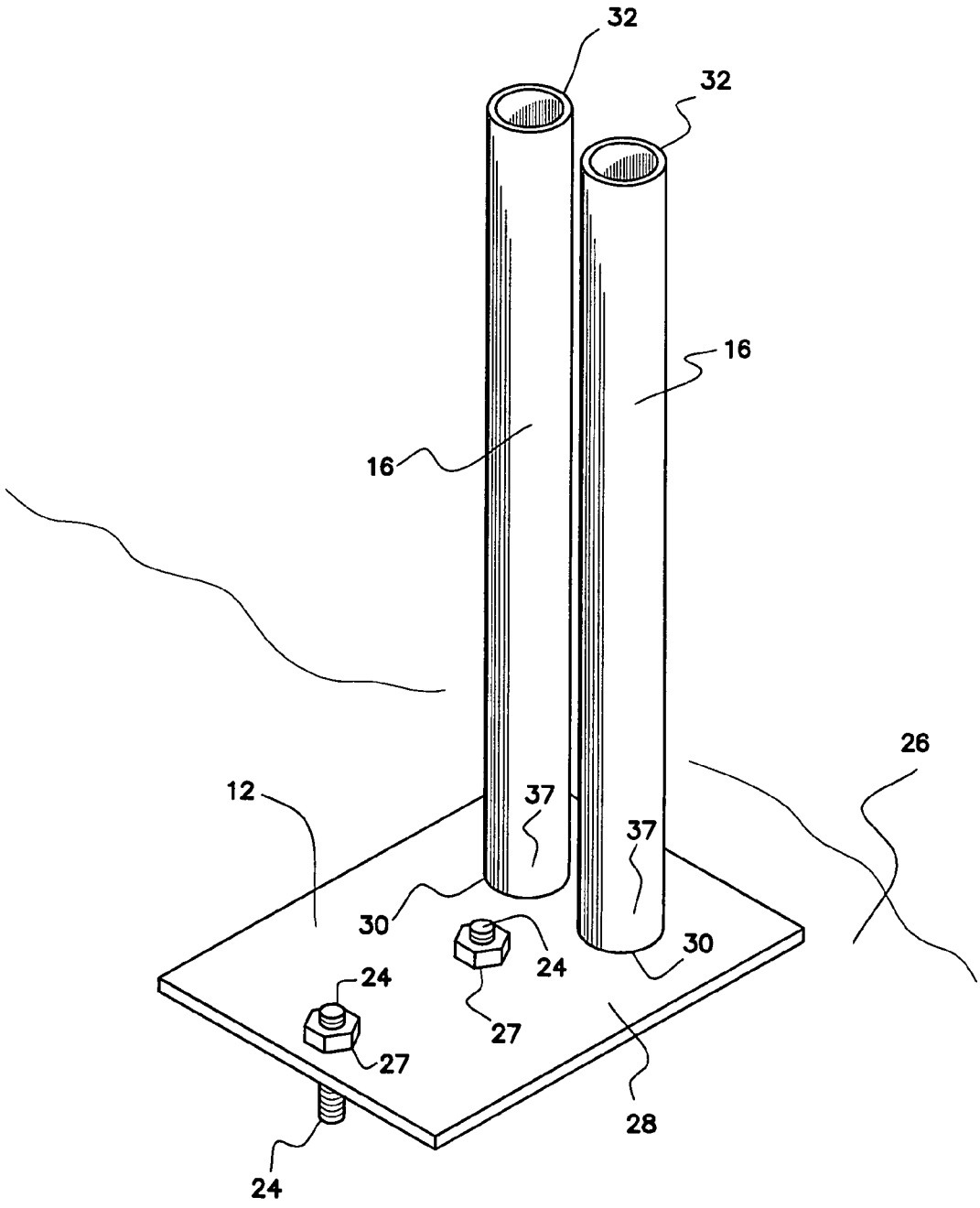
FIG. 2 is a perspective view of a baseplate with inner stanchions extending therefrom in accordance with the present invention.
Figure 3:
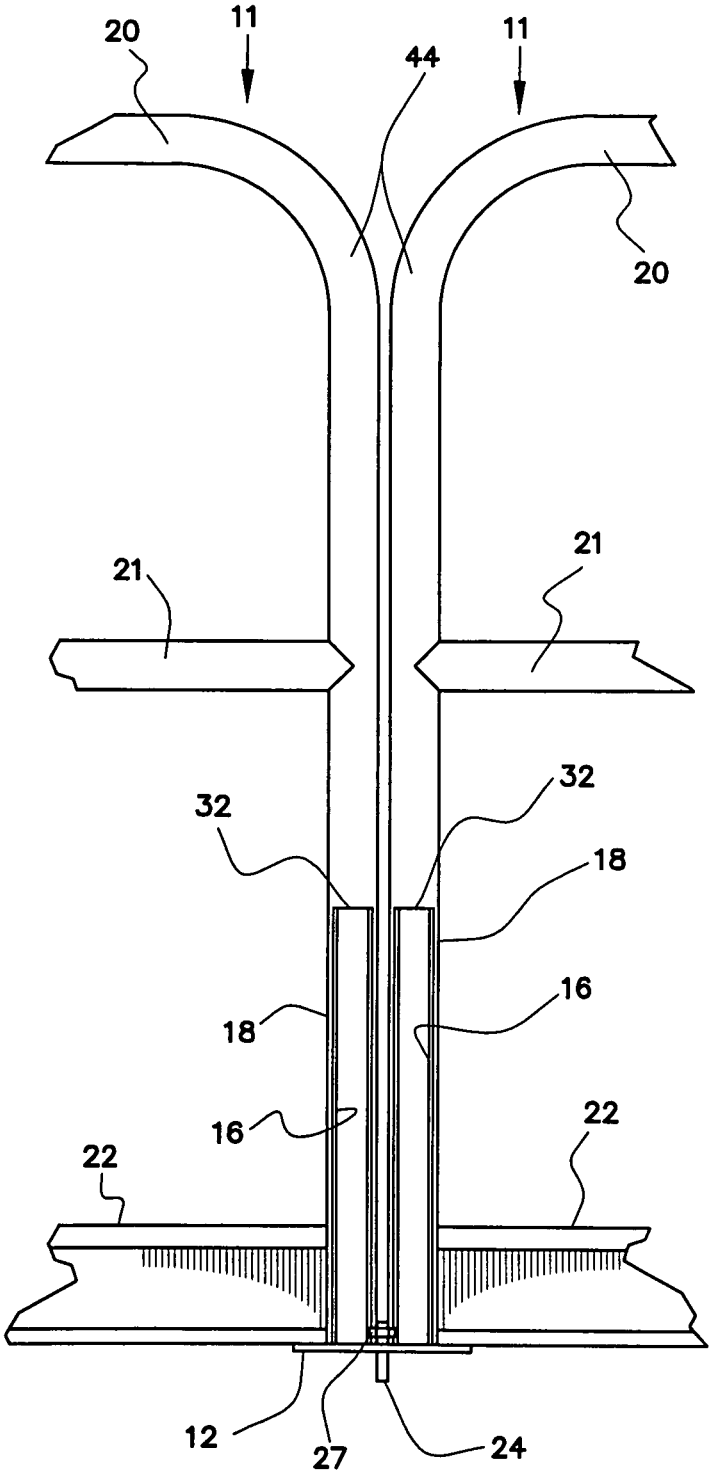
FIG. 3 is a front sectional view of portions of two rail sections disposed upon a baseplate in accordance with the present invention.
Figure 4:
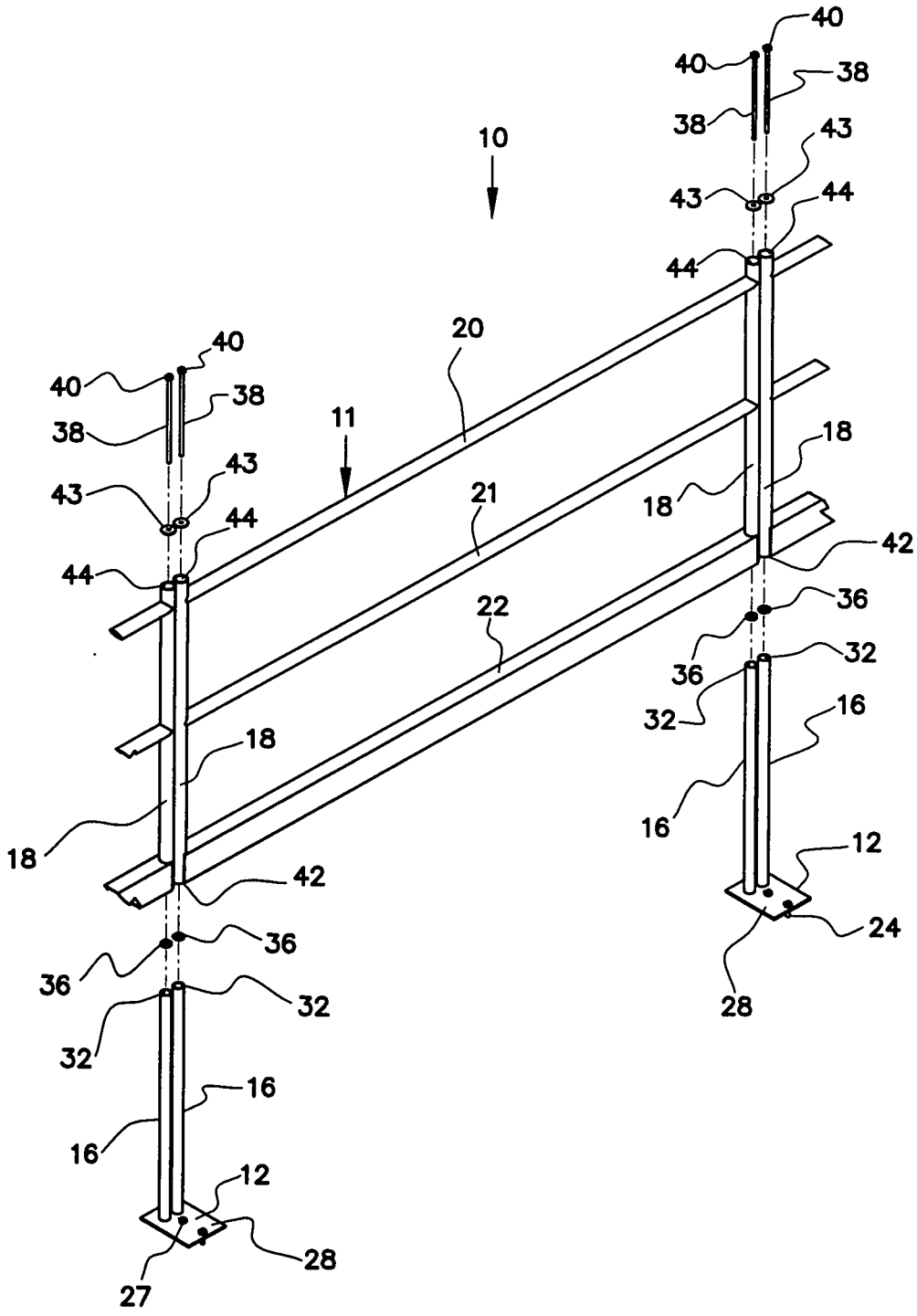
FIG. 4 is a perspective view of a modified safety rail in accordance with the present invention.
Figure 5:
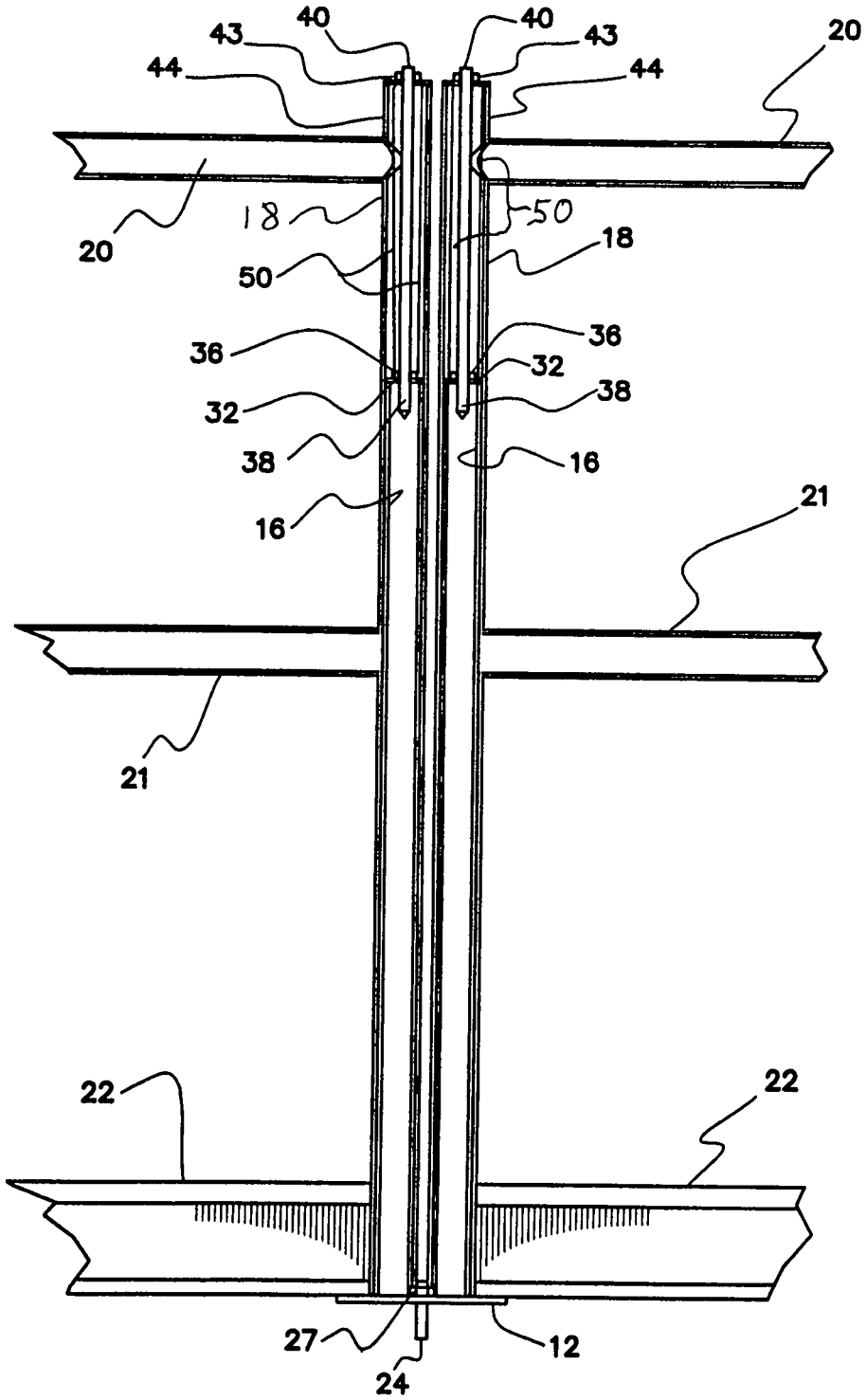
FIG. 5 is a front sectional view of the modified safety rail of FIG. 4.
Figure 6:
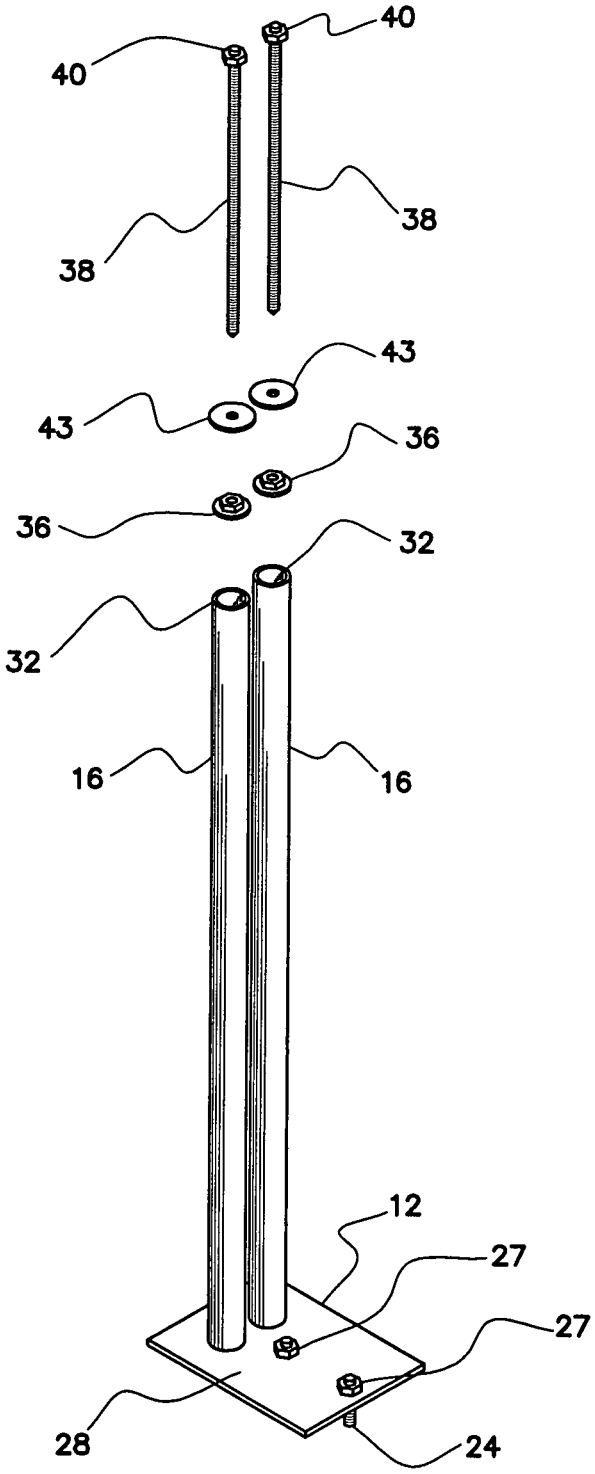
FIG. 6 is a perspective view of a baseplate with inner stanchions extending therefrom and joining members disposed above the inner stanchions for the modified safety rail of FIG. 4.
Figure 7:
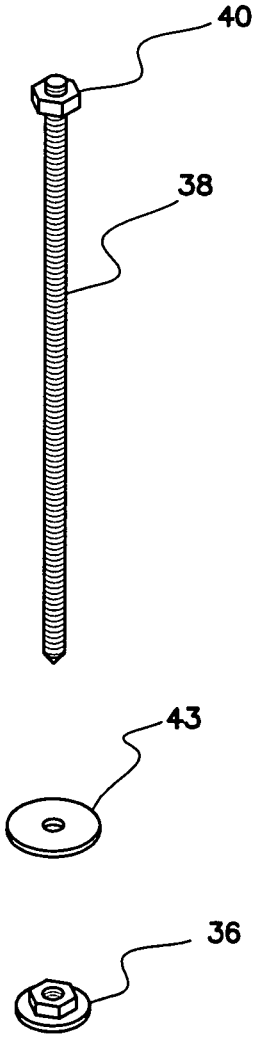
FIG. 7 is a perspective view of a joining member for the modified safety rail of FIG. 4.
Figure 8:
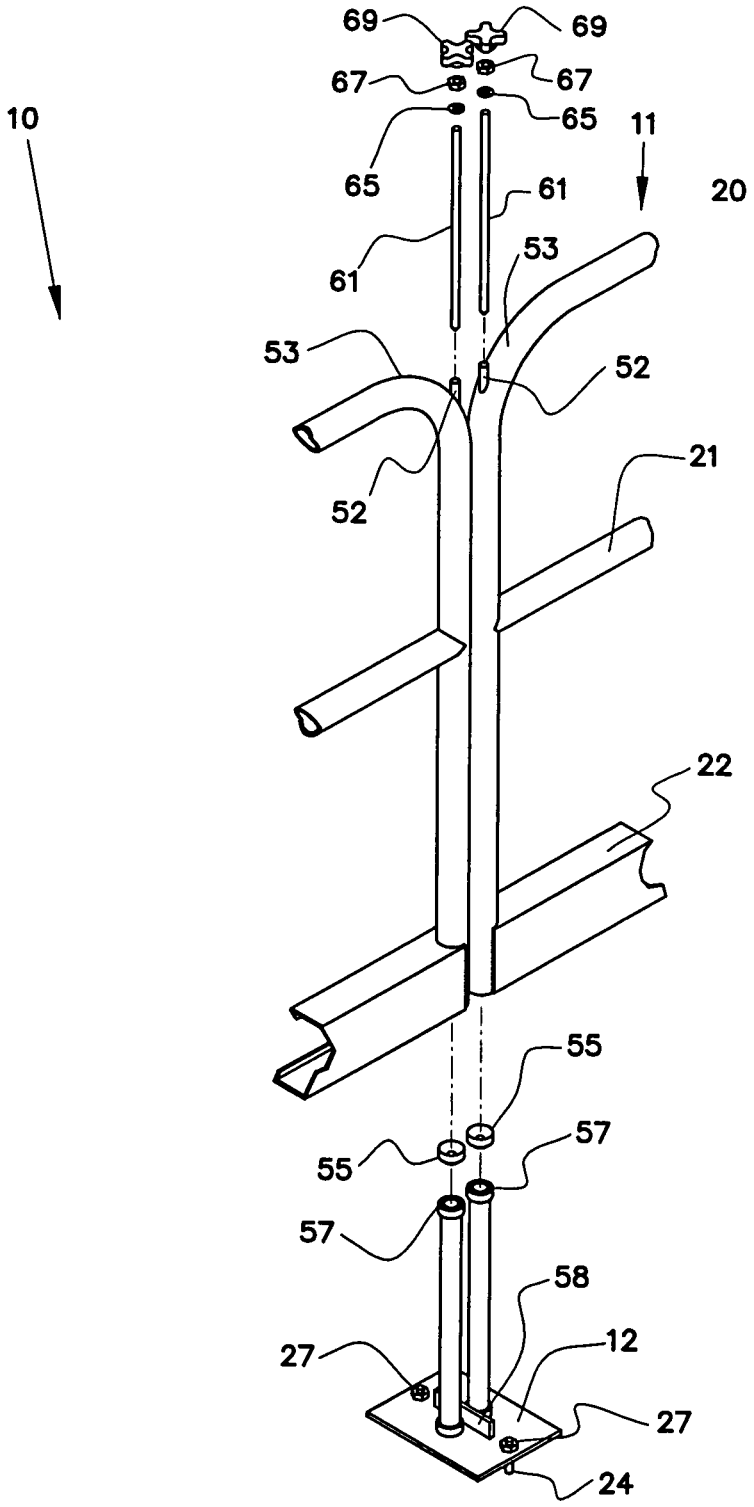
FIG. 8 is a perspective view of a second modified safety rail in accordance with the present invention.
Figure 9:
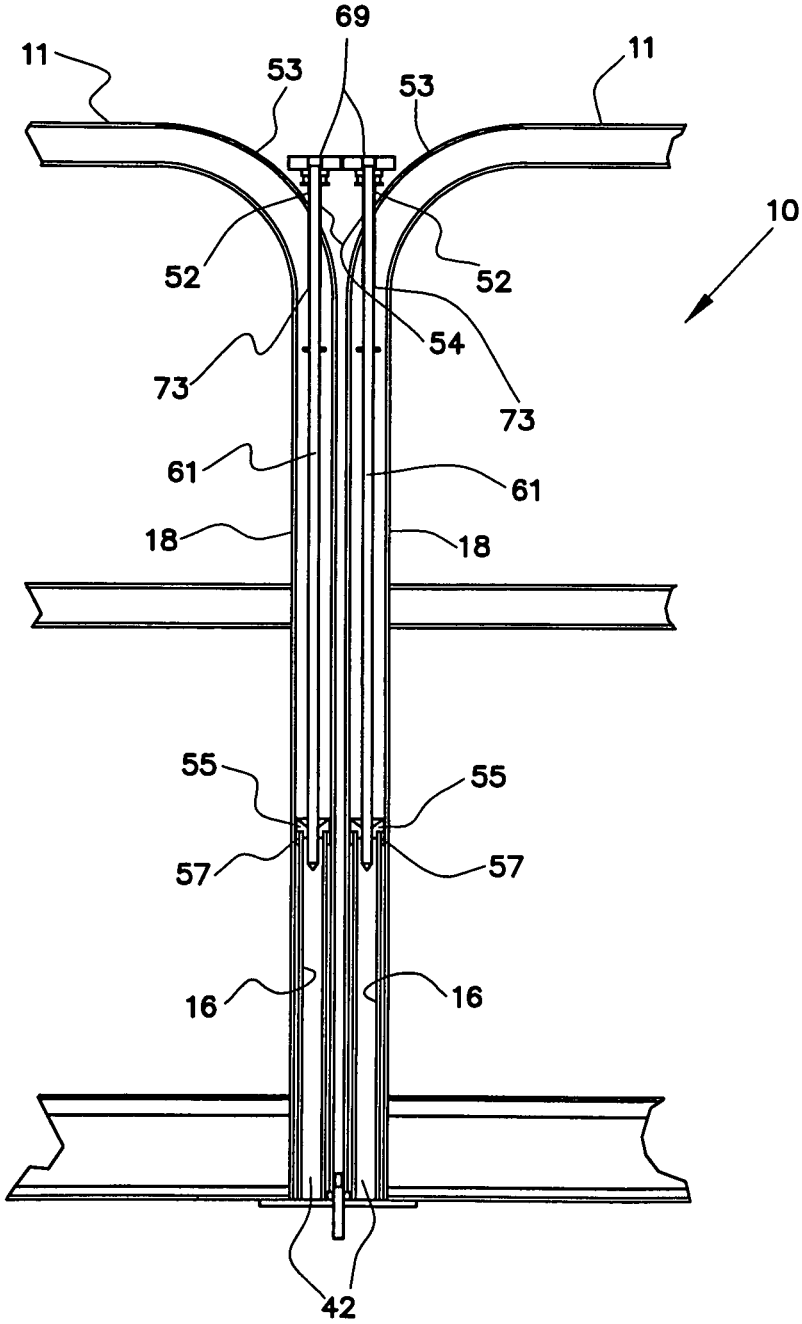
FIG. 9 is a front sectional view of the second modified safety rail of FIG. 8.
Figure 10:
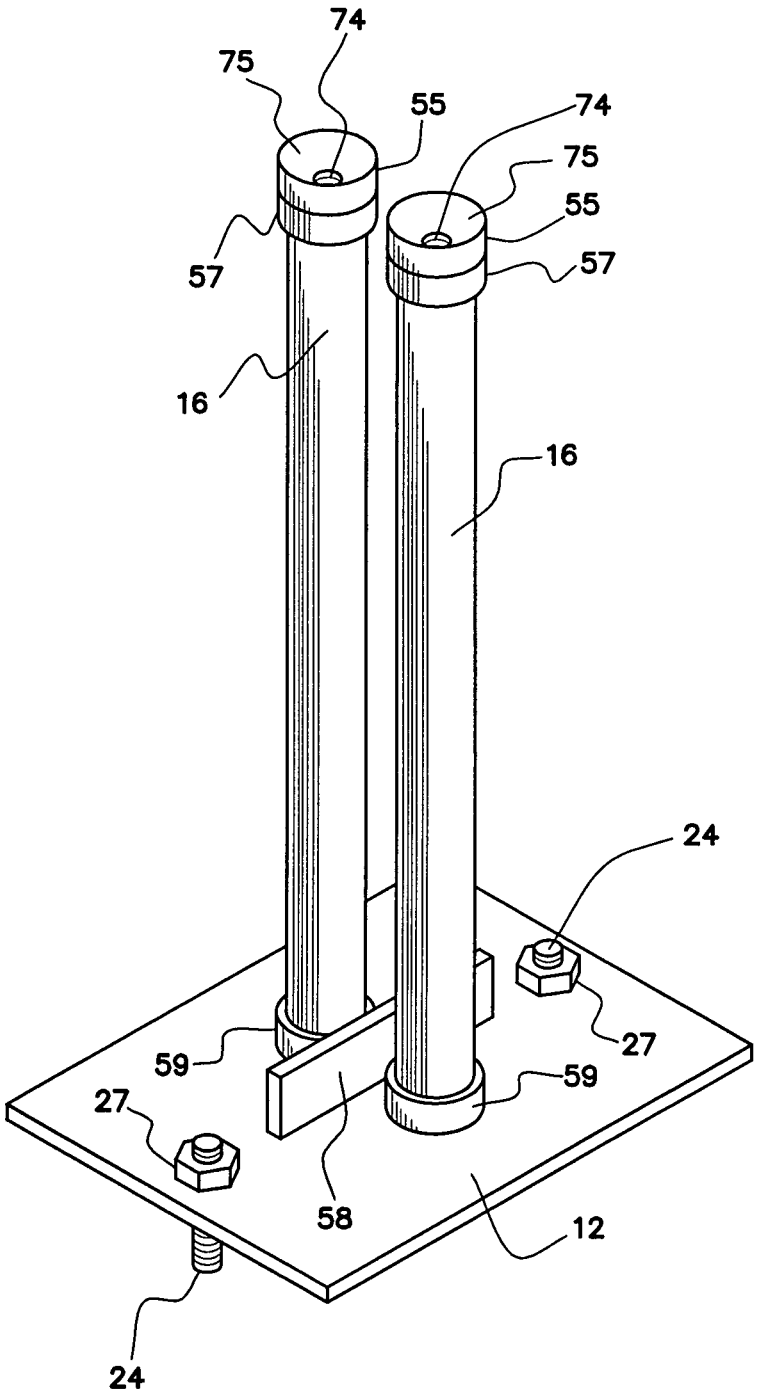
FIG. 10 is a perspective view of a baseplate with inner stanchions extending therefrom for the second modified safety rail of FIG. 8.
Figure 11:
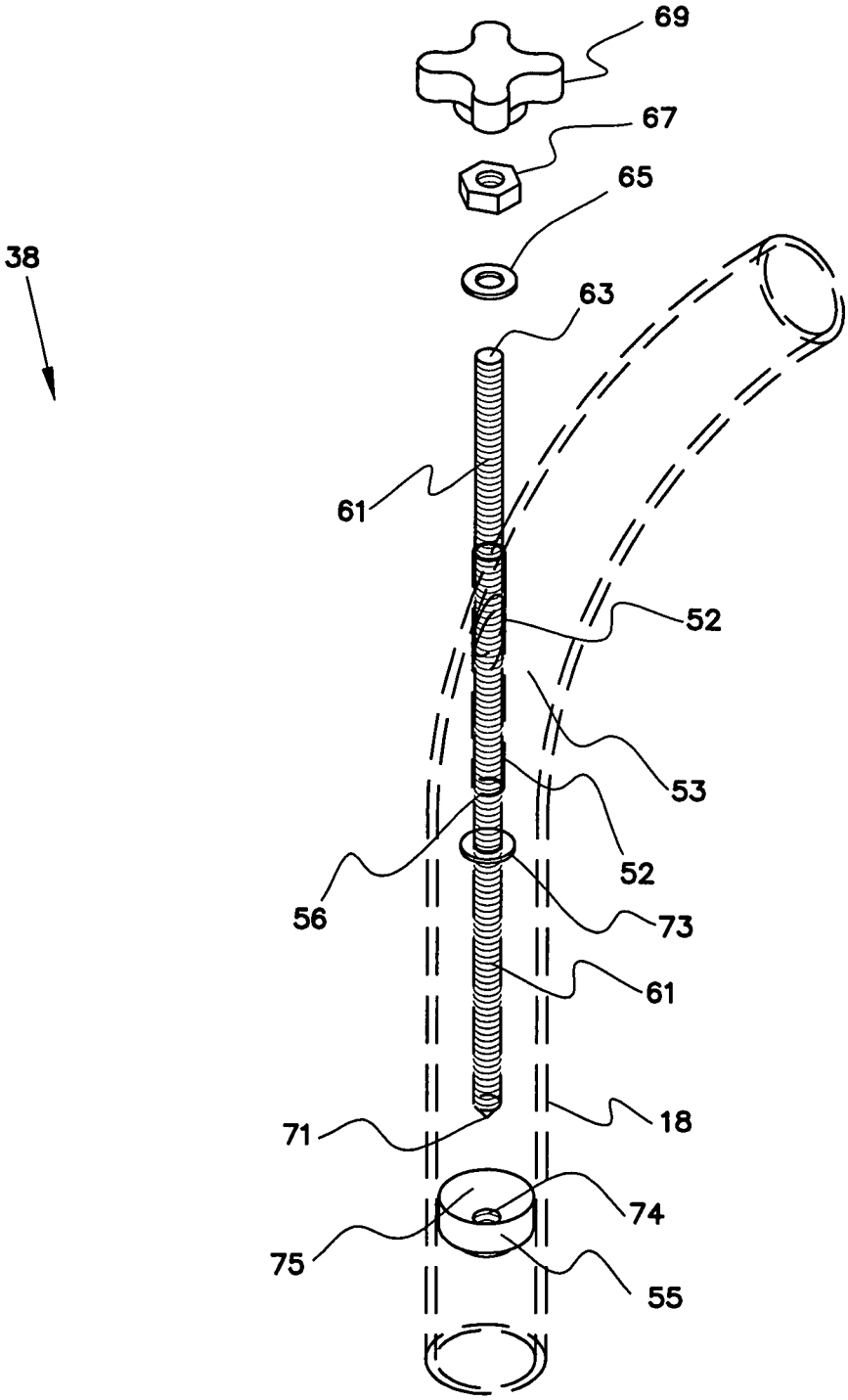
FIG. 11 is a perspective exploded and phantom view of a joining member for the second modified safety rail of FIG. 8.
Figure 12:
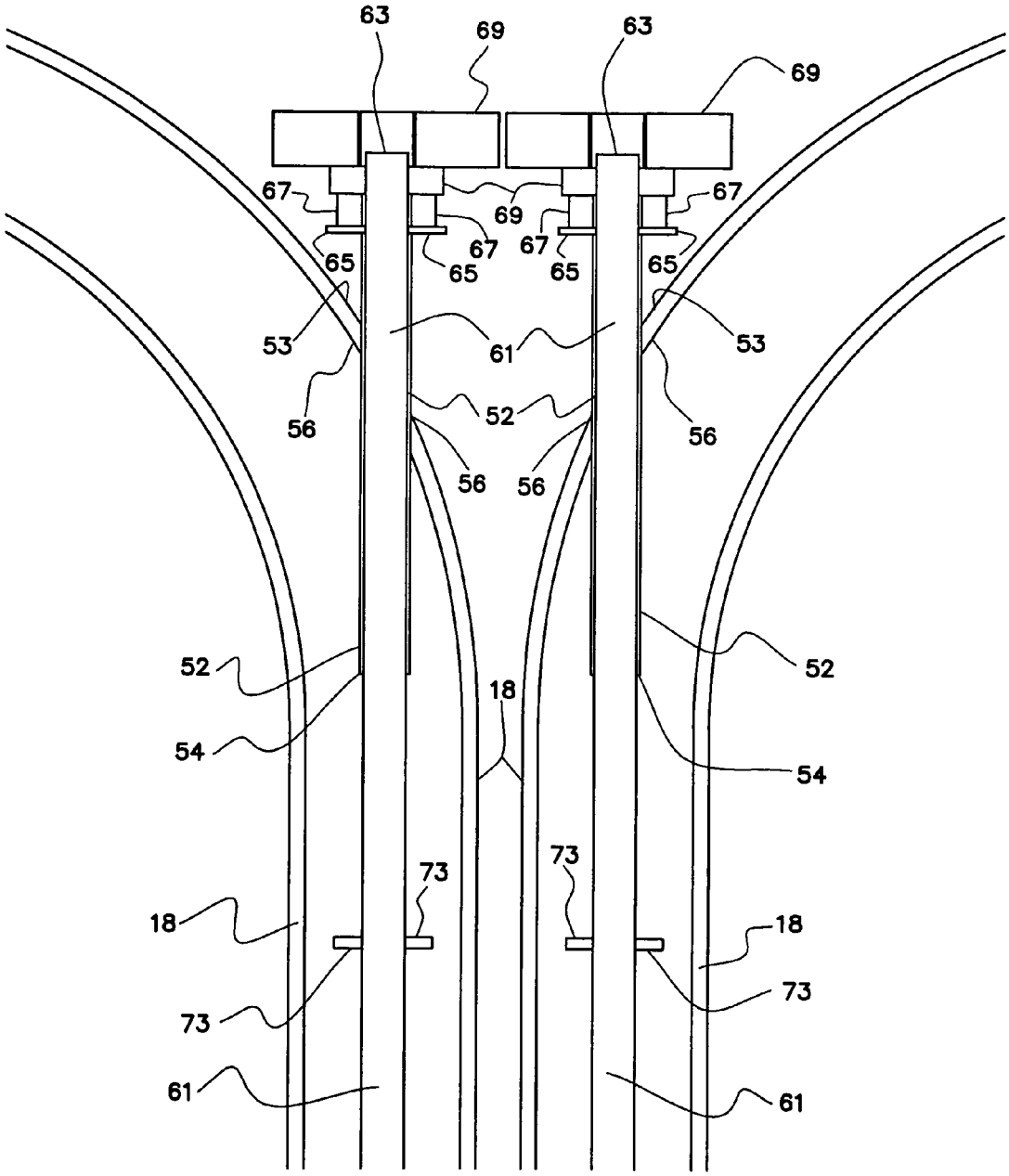
FIG. 12 sectional view of an upper portion of the front sectional view of FIG. 9.
Figure 13:
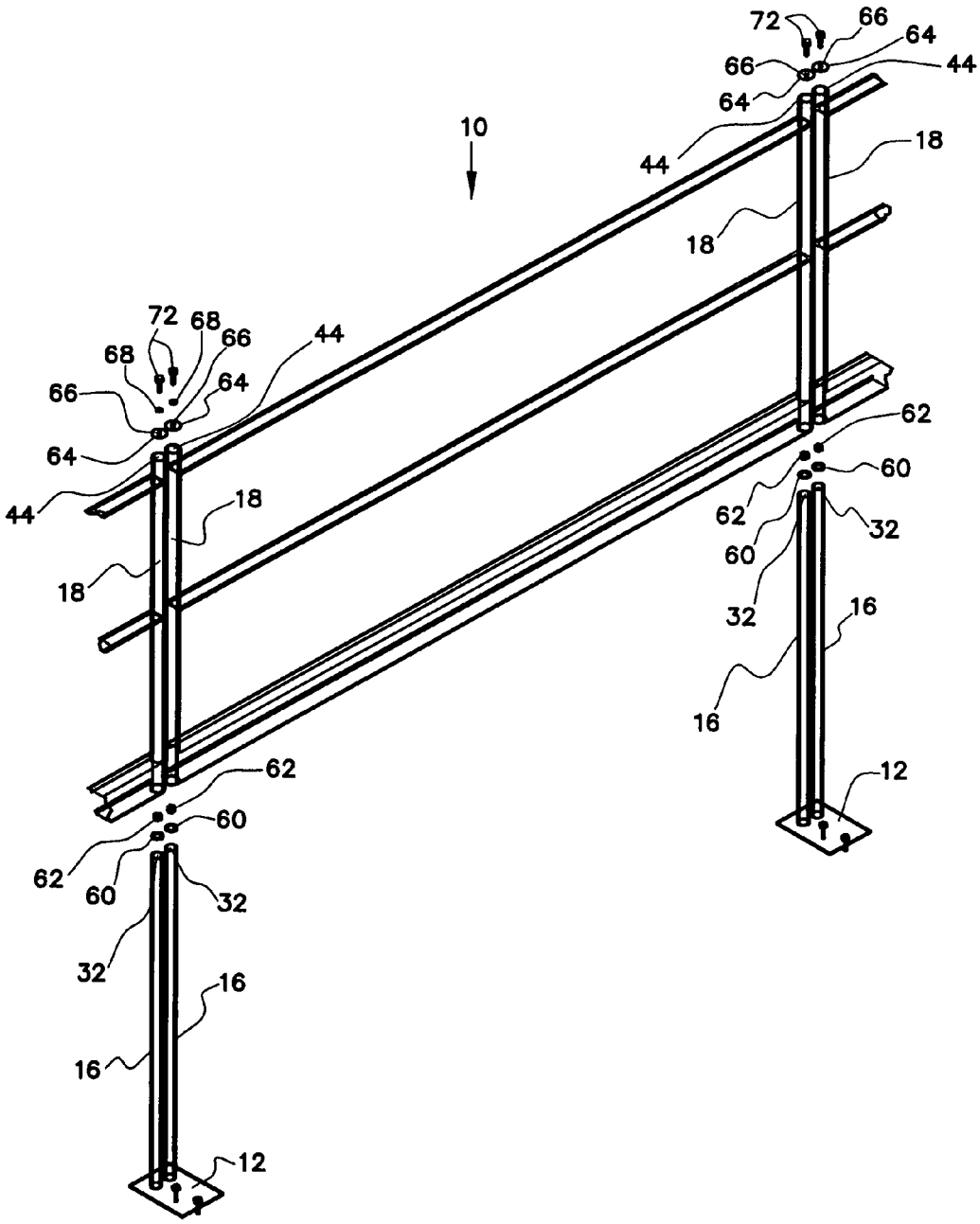
FIG. 13 is a perspective view of a third modified safety rail in accordance with the present invention.
Figure 14:
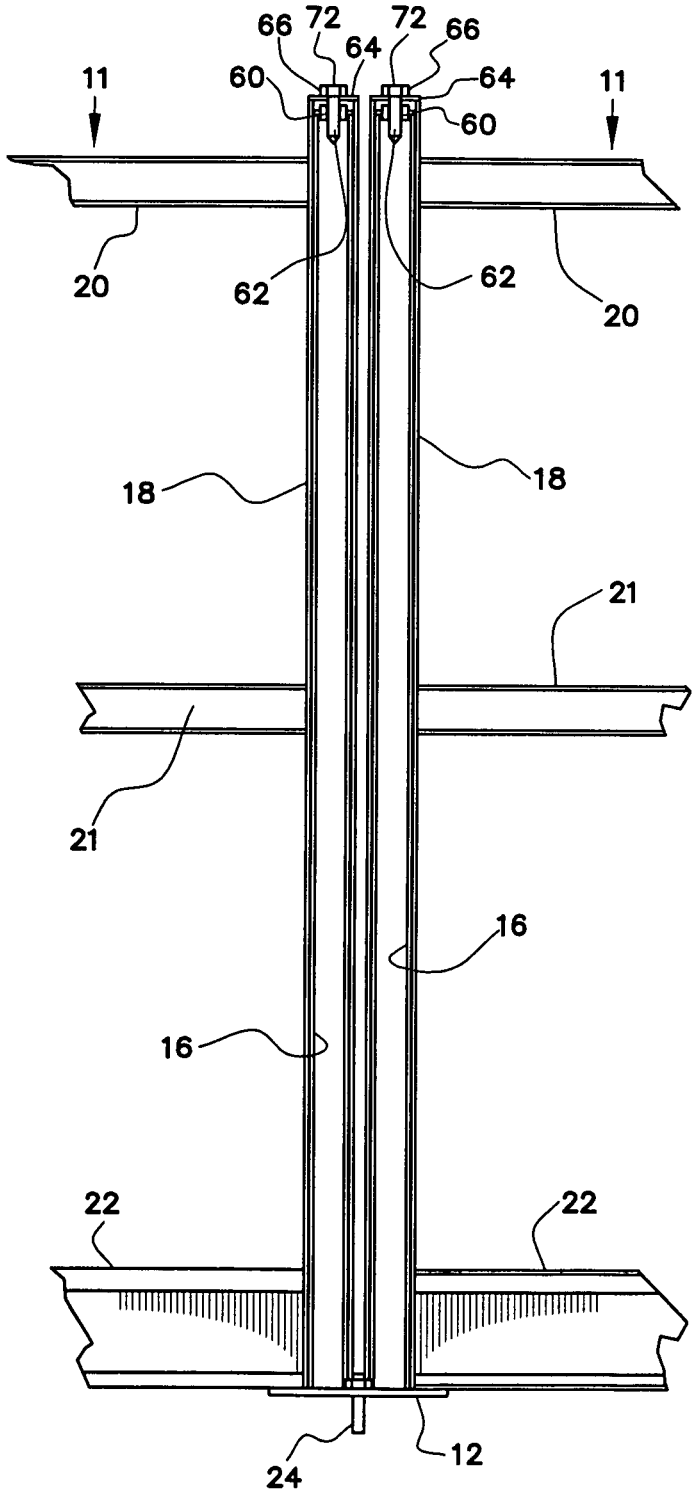
FIG. 14 is a front sectional view of the third modified safety rail of FIG. 13.
Figure 15:
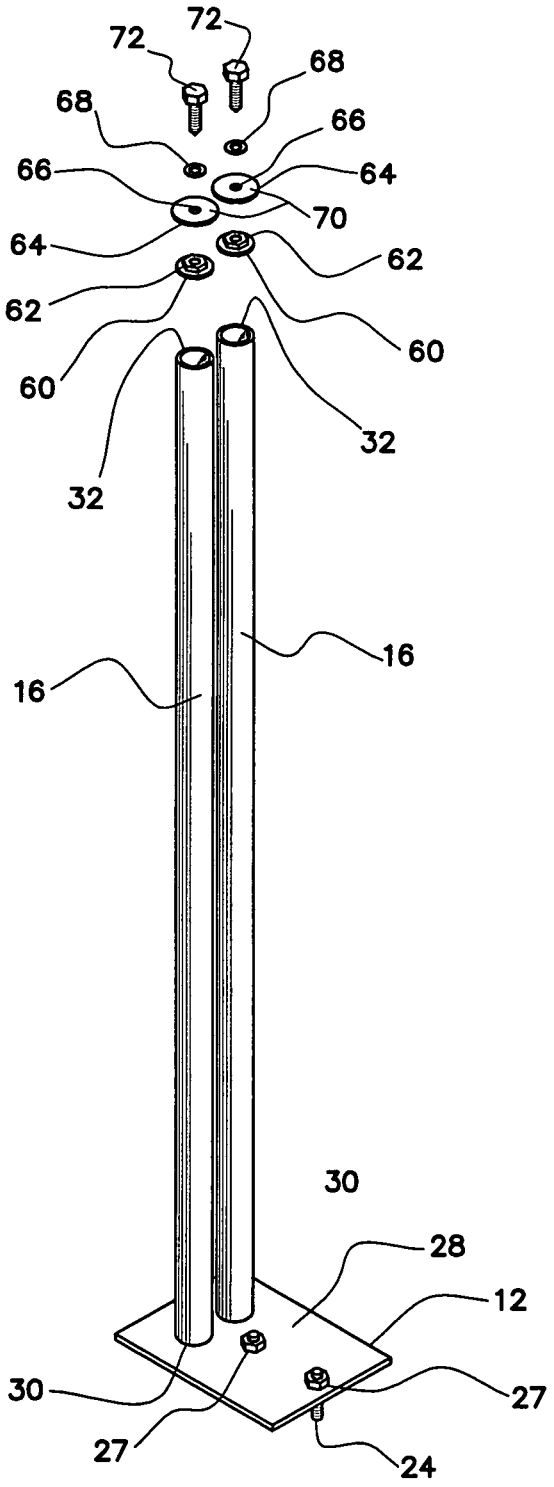
FIG. 15 is a perspective view of a baseplate with inner stanchions extending therefrom and joining members disposed above the inner stanchions for the third modified safety rail of FIG. 13.
Figure 16:
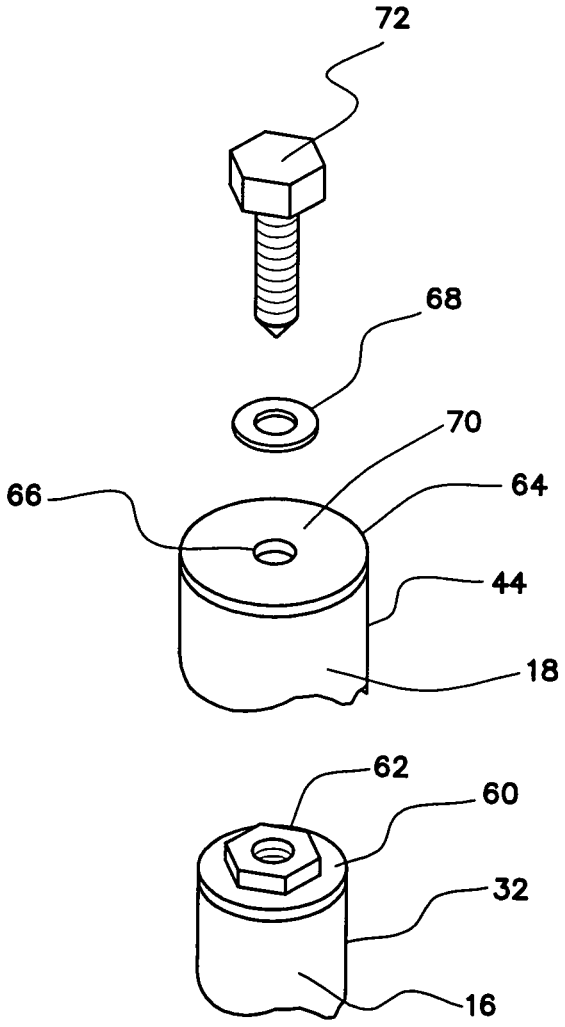
FIG. 16 is a perspective view of a joining member for the third modified safety rail of FIG. 13.
Figure 17:
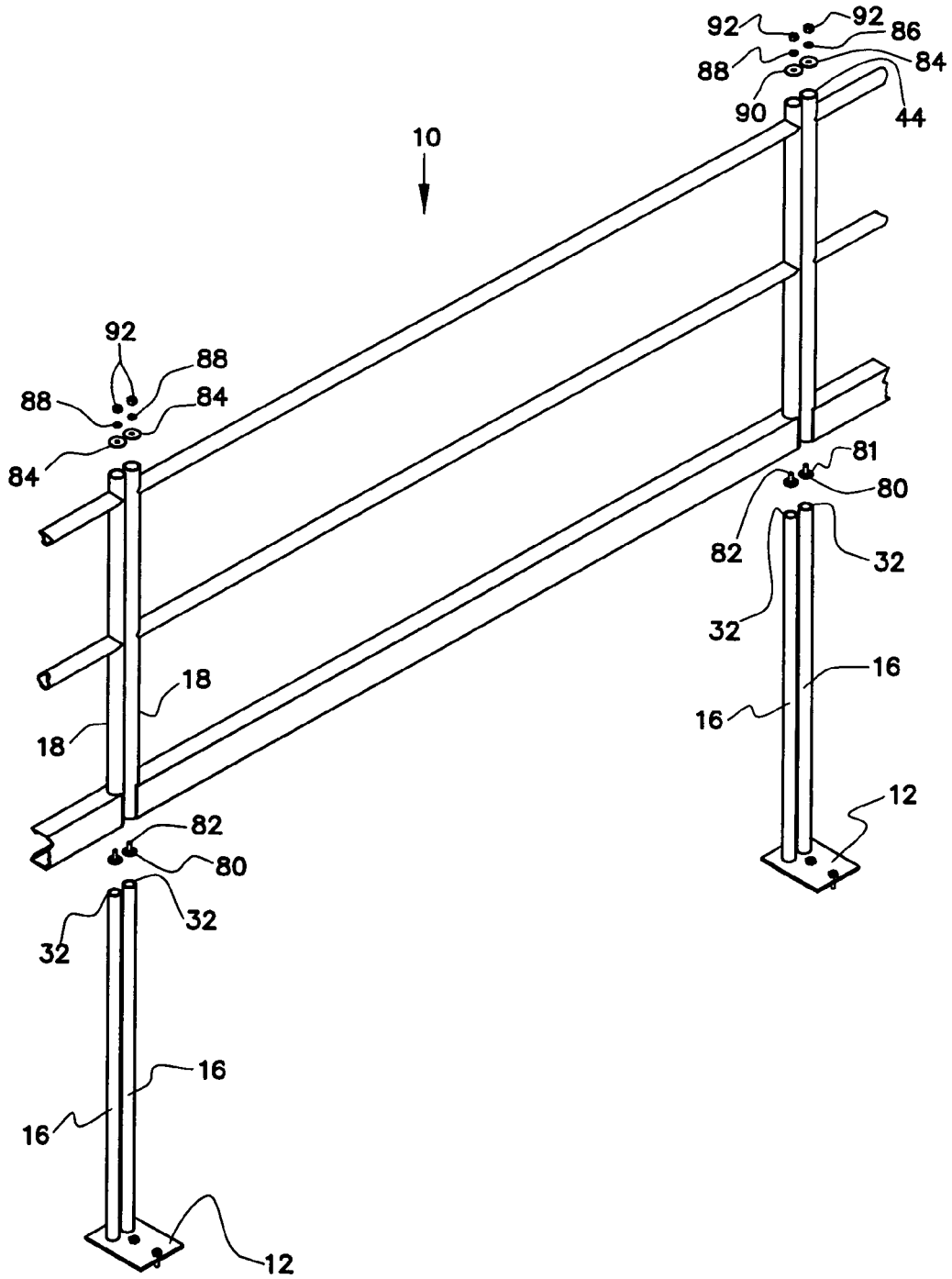
FIG. 17 is a perspective view of a fourth modified safety rail in accordance with the present invention.
Figure 18:
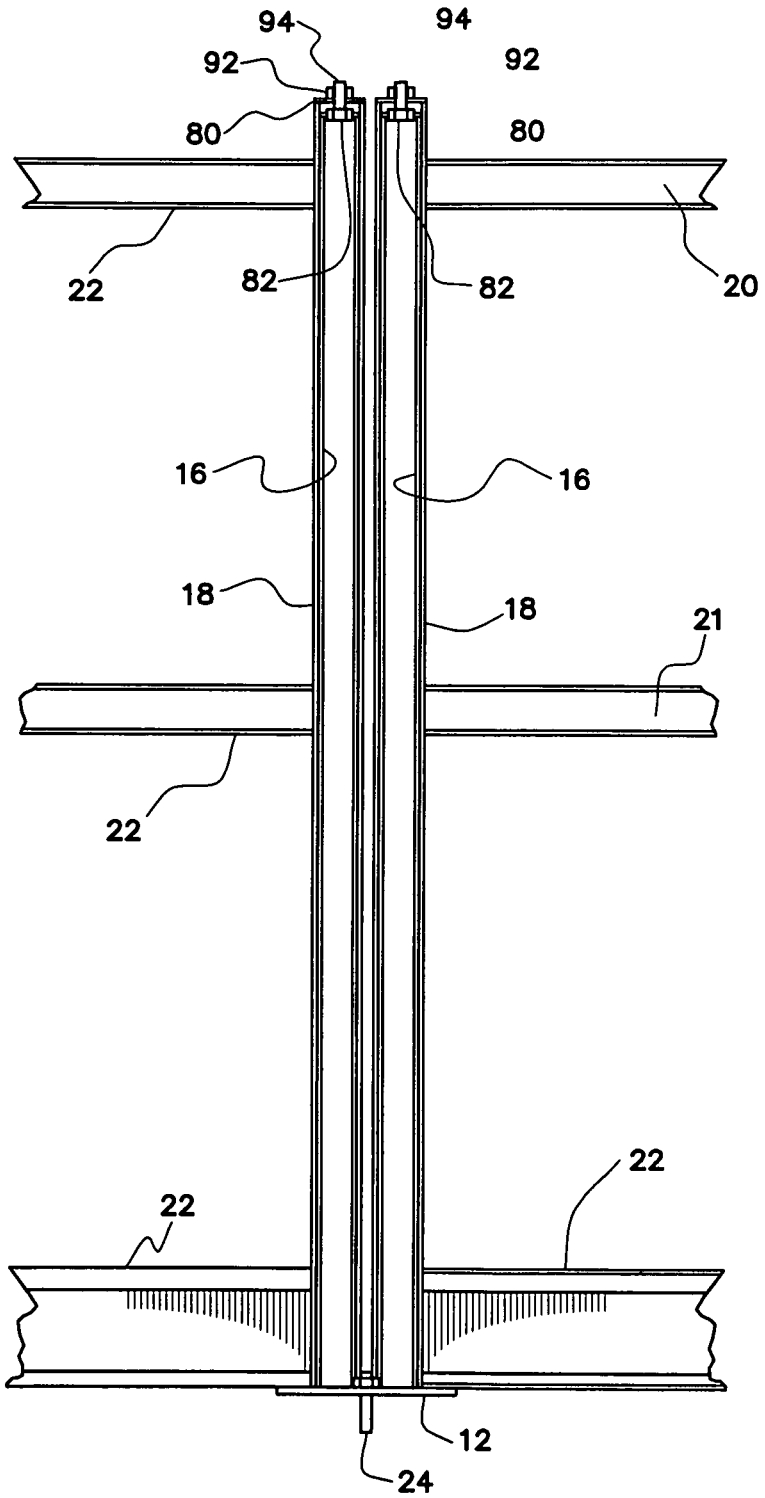
FIG. 18 is a front sectional view of the fourth modified safety rail of FIG. 17.
Figure 19:
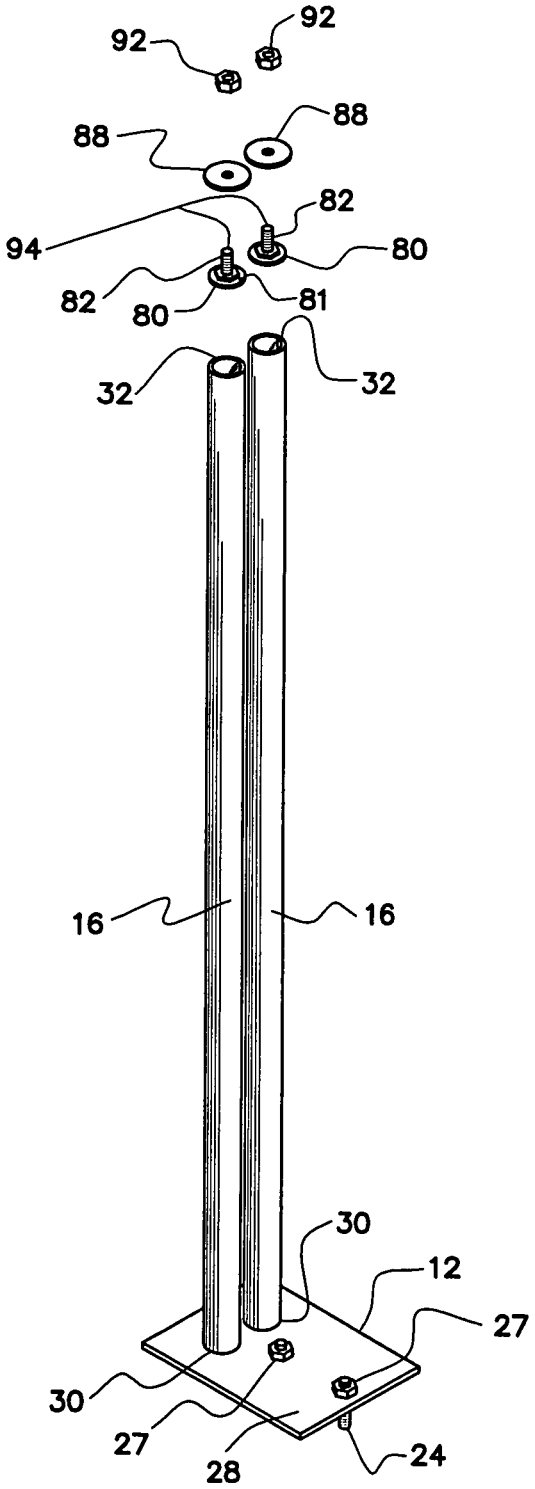
FIG. 19 is a perspective view of a baseplate with inner stanchions extending therefrom and joining members disposed above the inner stanchions for the fourth modified safety rail of FIG. 17.
Figure 20:
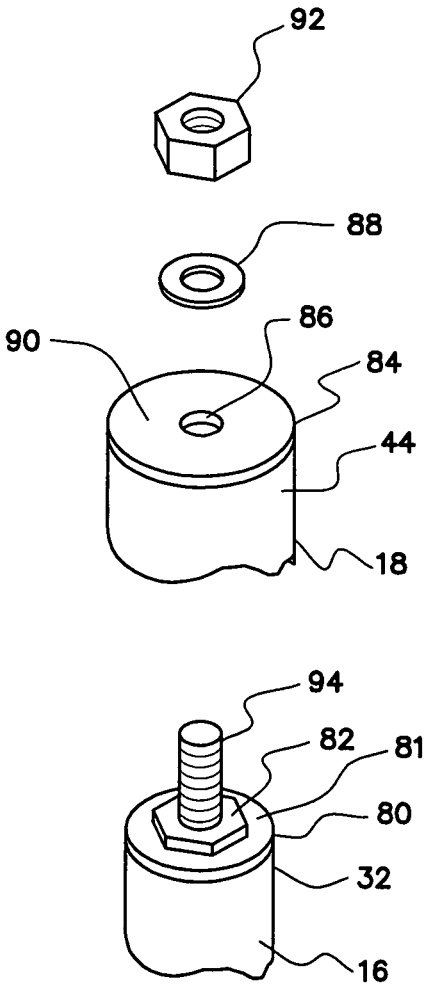
FIG. 20 is a perspective view of a joining member for the fourth modified safety rail of FIG. 17.

Referring now to FIGS. 1-3, a safety rail for the perimeter of an open floor of building under construction is denoted as numeral 10. The safety rail 10 includes multiple rail sections 11 disposed upon adjacent spatially separated baseplates 12 that are secured to a floor surface 14 via anchor bolts 24 integrally inserted into a floor portion 27. Cooperating nuts 27 are rotationally secured to the anchor bolts 24 until the nuts 27 forcibly engage the baseplates 12. The baseplates 12 include a pair of substantially vertical inner stanchions 16 integrally joined to each baseplate 12 via welding or similar means well known to those of ordinary skill in the art. The rail sections 11 are secured to the baseplates 12 via substantially vertical outer stanchions 18 integrally formed into the rail sections 11, the outer stanchions 18 are snugly slid upon cooperating inner stanchions 16 by an individual such that the rail sections 11 are vertically maintained when released by the individual. Top, middle and bottom guard members 20, 21, and 22 are integrally joined to cooperating outer stanchions 18 such that a rail section 11 is fabricated with a predetermined vertical elevation sufficient to protect personnel working on an open floor area in a building under constriction.

The vertical or longitudinal dimensions of the inner and outer stanchions 16 and 18 cooperate to provide stability and safety to the rail section 11 when the outer stanchions 18 are disposed over the inner stanchions 16. The longer the inner stanchion 16, the more stability provided to the outer stanchion 18, and the more unlikely the outer stanchion 18 would be accidently elevated from the inner stanchion 16, which could result in an individual falling from the open floor area. The vertical dimension of the outer stanchions 18 is ultimately determined by the rail section 11 vertical safety elevation required by the individuals working on the open floor area. Once the vertical dimension for the outer stanchions 18 has been selected, a vertical dimension for the inner stanchions 16 is selected that allows a first end 42 of the outer stanchion 18 to rest upon the baseplate 12, while disposing the second end 32 of the inner stanchion 16 slightly lower in elevation than the second end 44 of the outer stanchion 18, thereby maximizing stability and safety for the rail section 11. Obviously, a shorter vertical dimension for the inner stanchion 16 may be selected, however, stability and safety would be comprised. To prevent the outer stanchion 18 from being separated from the inner stanchion 16, the first end 42 of the outer stanchion 18 may be secured to the first end 30 of the inner stanchion 16 via aperture and cotter pins or similar securing means well known to those of ordinary skill in the art.

The baseplate 12 is dimensioned to provide a stable attachment between the rail sections 11 and the floor surface 14 irrespective of the force imparted upon the safety rail 10. Typically, the baseplate 12 is a one-quarter inch thick plate of steel with a length of nine inches and a width of six inches. The baseplate 12 is secured to a floor surface 14 via threaded mounting studs 24 drilled into and integrally joined to a floor portion 26. Cooperating nuts 27 secure the baseplate 12 to the mounting studs 24 such that the baseplate 12 maintains congruent engagement with the floor surface 14. The baseplate 12 includes two inner stanchions 16 perpendicularly joined to a top wall 28 of the baseplate 12 via welding or similar means, thereby maintaining the inner stanchions 16 in a substantially vertical position after the baseplate 12 is congruently secured to the floor surface 14, irrespective of a substantially horizontal force being imparted upon the inner stanchion 16. The two inner stanchions 16 are spatially separated a distance that allows cooperating outer stanchions 18 to snugly slide upon the two inner stanchions 16 such that the outer stanchions 18 do not engage each other.

The inner stanchion 16 includes a two inch diameter, four feet long piece of schedule forty steel pipe having a first end 30 welded to the baseplate 12. A second end 32 of the inner stanchion 16 may be open or covered. If the outer stanchion 18 is simply slid over the inner stanchion 16 and there is no need to secure the outer stanchion 18 to the inner stanchion, then no joining means is required between the two stanchions 16 and 18. If increased safety and stability is required for the safety rail 10, then the outer stanchion 18 is secured to the inner stanchion 16 via a top portion 40 of a threaded joining member 38 engaging a washer 43 which in turn engages a second end 44 of the outer stanchion 18. The threaded joining member 38 rotationally engages a nut 36 centered and welded inside the second end 32 of the inner stanchion 16 (see FIGS. 4-7). The dimensions of the inner stanchion 16 may vary depending upon the expected maximum magnitude of force ultimately imparted upon the safety rail 10. The dimensions of the baseplate 12, outer stanchion 18 and guard members 20 will correspondingly vary. The dimensioning of the safety rail 10 as a function of expected maximum force imparted upon the safety rail 10 is well known to those of ordinary skill in the art. The nut 36 is orientated to vertically receive the threaded joining member 38, which can be a bolt, rod or pipe. The top portion 40 of the joining member 38 and the washer 43 ultimately capture and secure the outer stanchion 18 to the inner stanchion 16. A plurality of drain apertures 37 are provided at the base of the first end 30 of the inner stanchion 16 to allow rain and moisture collected between the baseplate 12 and the first end 30 to exit the inner stanchion 16.

The outer stanchion 18 includes a portion of schedule forty steel pipe having a diameter and length relatively larger than the corresponding diameter and length of the inner stanchion 16 to promote the snug disposition of the outer stanchion 18 over the inner stanchion 16. The relatively larger outer stanchion 18 slides over the inner stanchion 16 until a first end 42 of the outer stanchion 18 engages the top wall 28 of the baseplate 12. If the outer stanchion 18 must be secured to the inner stanchion 16, then a shaft portion 39 of the joining member 38 is inserted into an open second end 44 of the outer stanchion 18 until a threaded bottom portion 41 of the shaft portion 39 engages nut 36 in the inner stanchion 16 (see FIGS. 4-7). The joining member 38 is then rotated via manual or tool means such that the threaded bottom portion 41 inserts into the nut 36 until the top or knob portion 40 of the joining member 38 engages the second end 44 of the outer stanchion 18, thereby forcibly securing the outer stanchion 18 to the inner stanchion 16, resulting in a rigid, stable stanchion assembly capable of supporting the guard members 20 such that workers are prevented from falling from a floor of a building under construction to the ground below. A plurality of drain apertures 48 are provided at the base of the first end 42 of the outer stanchion 18 to allow rain and moisture collected between the baseplate 12 and the first end 42 of the outer stanchion 18, and rain and moisture exiting the inner stanchion 16 to exit the outer stanchion 18 and flow upon the floor surface 14.

Referring now to FIGS. 8-12, an alternative design for securing the outer stanchion 18 to the inner stanchion 16 via the joining member 38 in accordance with the present invention is depicted. The alternative design includes a metal cylindrical sleeve 52 integrally joined via welding or similar means to an upper arcuate portion 53 of the outer stanchion 18. A bottom portion 54 of the sleeve 52 is configured to congruently engage the upper arcuate portion 53 such that the sleeve 52 is axially aligned with the outer stanchion 18 and with an aperture 56 in the upper arcuate portion 53, thereby providing access to the outer stanchion 18 and the inner stanchion 16 therein for a threaded joining member 38 to rotationally engage a cooperatively threaded funnel member 55 that is secured to an upper collar 57 which is integrally joined to the second end 32 of the inner stanchion 16. The upper collar 57 provides increased surface area for improving the weld maintaining the position of the funnel member 55 relative to the inner stanchion 16.

The baseplate 12 includes a steel reinforcing bar 58 welded to the baseplate 12 and disposed between lower securing collars 59 that integrally join the inner stanchions 16 to the baseplate 12. The reinforcing bar 58 prevents the baseplate 12 from deforming when a person leans against or otherwise imparts a force upon the assembled safety rail 10. A deformed baseplate 12 allows corresponding rail sections 11 to "bend" opposite to the direction of the imparted force, which could cause a person to fall from the floor area being guarded by the safety rail 10. The securing collars 59 provide increased surface area for securing the inner stanchions 16 to the baseplate 12 via welding or similar means, thereby maintaining the inner stanchions 16 in a substantially vertical position irrespective of the force imparted to the outer stanchions 18 via the rail sections 11.

The joining member 38 includes a threaded rod 61 having a blunt upper end 63 that inserts through a sleeve engagement washer 65 and rotationally inserts through a retaining nut 67 and into a handle 69. The joining member 38 further includes a relatively "pointed" lower end 71 that "finds" and is inserted into a threaded aperture 74 in the funnel member 55, then promotes rotational engagement between the rod 61 and the funnel member 55 to ultimately secure the joining member 38 and the outer stanchion 18 to the inner stanchion 16. A retaining washer 73 is welded to an upper portion of the threaded rod 61 to prevent the joining member 38 from being extracted or otherwise removed from the outer stanchion 18, thereby preventing the joining member from being lost or damaged which would eventually occur should the joining member 38 be separated from the outer stanchion 18. The retaining washer 73 includes a diameter dimensioned slightly larger than the diameter of the sleeve 52 to prevent the washer 73 from being manually urged through the sleeve 52 and extracted from the outer stanchion 18. The sleeve engagement washer 65 promotes the forcible rotation of the retaining nut 67 against the sleeve 52 to "lock-in" the position of the outer stanchion relative to the joining member 38 and the inner stanchion 16 without excessive wear to cooperating surfaces of the retaining nut 67 and the sleeve 52.

The joining member 38 is secured to the outer stanchion 18 by inserting the upper end 63 of the rod 61 (without the washer 65, retaining nut 67 or handle 69 attached) through the first end 42 of the outer stanchion 18, which is separated from the inner stanchion 16, and through the sleeve 52; whereupon, the washer 65, retaining nut 67 and handle 69 are secured to the upper end 63 of the rod 61. The removable handle 69, nut 67 and washer 65 cooperate with the fixed location of the retaining washer 73 upon the rod 61 to secure the joining member 38 to the outer stanchion 18, while allowing the rod 61 to axially slide within the sleeve 52 a longitudinal distance determined by distance between the retaining washer 73 and the bottom portion 54 of the sleeve 52 when the retaining nut 67 urges the washer 65 into engagement with the sleeve 52.

The safety rail 10 is assembled by disposing the outer stanchion 18 upon the inner stanchion 16. As the outer stanchion 18 is lowered upon the inner stanchion 16, the pointed lower end 71 of the rod ultimately engages a "downwardly" sloping funnel wall 75 of the funnel member 55 which urges the lower end 71 into the threaded aperture 74; whereupon, the handle 69 is manually rotated to secure the outer stanchion 18 upon the inner stanchion 16. In the event that the lower end 71 of the rod 61 did not slide upon the funnel wall 75, but was instead "locked" in place due to misalignment between the rod 61, outer stanchion 18 and/or inner stanchion 16, then the rod 61 could be bent or otherwise damaged such that structural integrity of the assemble safety rail 10 would be compromised.

To prevent damage to the rod 61, the retaining washer 73 is positioned upon the rod 61 such that sufficient longitudinal movement of the rod within the outer stanchion 18 is provided to allow the lower end 71 of the rod to "rest" upon the funnel wall 75 without any weight or manual force from the outer stanchion 18 transferred to the rod 61. To remove the outer stanchion 18 from the inner stanchion 16, the handle 69 is manually rotated to extract the rod 61 from the funnel member 55; whereupon, the rail section 11 and outer stanchion 18 is separated from the inner stanchion 16. The joining member 38 will remain with the outer stanchion 18 until the handle 69, retaining nut 67 and washer 65 are removed from the rod 61, thereby allowing the rod 61 to be manually pulled from the first end 42 of the outer stanchion 18.

Multiple guard members 20, 21 and 22 having a length not exceeding eight feet are integrally joined to adjacent outer stanchions 18 to form one rail section 11. Alternatively, the guard members 20, 21 and 22 may be detachably secured to the outer stanchion 18 via clamp assemblies (manufactured by I B&M tubular Products, located at 1919 W. 19$^{th}$ St., Broadview, Ill. 60155) that provide a relatively fast attachment to form the rail sections 11 about a predetermined periphery of an open floor of a building under construction. The guard members 20, 21 and 22 include a myriad of configurations including, but not limited to steel cables, angle irons, steel flat bars, chain linked fence and combinations thereof. The selection of any particular guard member 20, 21 and 22 must be capable of resisting an expected maximum force that might be imparted upon safety rail 10.

A completed safety rail 10 extending about the perimeter of an open floor generally includes a height of about four feet. However, during the construction or after the completion of the safety rail 10, it may be determined that a safety rail 10 is required that is greater than four feet in height. The height of the safety rail 10 is quickly increased by rotationally removing the joining member 38 from the inner stanchion 16, then slidably lifting the outer stanchion 18 from the inner stanchion 16. An outer stanchion 18 having a length and guard members 20, 21 and 22 attached thereto that results in a safety rail 10 having the required height, is slidably disposed upon the inner stanchion 16. The joining member 38 is then reinserted into the longer outer stanchion 18 until rotationally engaging the inner stanchion 16, thereby securing the longer outer stanchion 18 to the inner stanchion 16. The replacement process is repeated for all the outer stanchions 18. In the event that the shaft portion 39 of the joining member 38 is not sufficiently long to have the threaded bottom portion 41 rotationally engage the centered nut 36, then a replacement joining member is provided with a shaft portion 39 having sufficient length to rotationally insert the threaded bottom portion 41 into the nut 36.

In the event that the lengthened outer stanchion 18 promotes and unstable or relatively "weak" force resistant outer stanchion and safety rail 10, a coupling member 50 (FIG. 5) such as a pipe or similar structure is disposed between the second end 32 of the inner stanchion 16 and the top portion 40 of the joining member 38. The coupling member 50 may be used with an open or covered second end 44 of the outer stanchion, so long as the ends of the coupling member 50 are designed to be removably secured to cooperating second ends 32 and 44 of the inner and outer stanchions 16 and 18. The pipe coupling member 50 allows the shaft portion 39 of the joining member 38 to longitudinally extend therethrough, thereby enabling the coupling member 50 to be quickly inserted or removed from the separated inner and outer stanchions 16 and 18. The coupling member 50 effectively "fills" the void between the second end 44 of an elevated outer stanchion 18, and the second end 32 of the inner stanchion 16, resulting in increased stability and force resistance for the outer stanchion 18 as well as the entire safety rail 10.

In operation, a safety rail 10 is constructed having a predetermined length substantially equal to the perimeter of an open floor of a building under construction. A quantity of baseplates 12, inner and outer stanchions 16 and 18, and guard members 20 are selected to provide a length of safety rail 10 sufficient to enclose the perimeter of a selected open floor. Further, the baseplates 12, inner and outer stanchions 16 and 18, and guard members 20 are selected and dimensioned to provide the required strength and stability required to contain an expected maximum force that might be imparted upon the safety rail 10 by a worker or machine. The baseplates, and the inner stanchions 16 integrally joined thereto, are disposed upon a floor surface 14 and spatially separated a predetermined distance. The baseplates are then joined to a floor portion 26 via anchor bolts 24 and nuts 27. An outer stanchion 18 is manually slid over the inner stanchion 16. If enhanced safety and stability is not required, then the outer stanchion 18 is not secured to the inner stanchion. If enhanced safety and stability is required, then the outer stanchion 18 is secured to the inner stanchion 16 via a threaded bottom portion 41 of a shaft portion 39 of a joining member 38 rotationally inserted into a nut 36 integrally joined to the second end 32 of the inner stanchion 16. The threaded bottom 41 is manually rotated into the nut 36 until a top portion 40 of the joining member 38 forcibly engages a second end 44 of the outer stanchion 18, such that the outer stanchion 18 is stable relative to the inner stanchion 16 irrespective of the magnitude and direction of force imparted upon the safety rail 10. The cooperating inner and outer stanchions 16 and 18 result in a rigid safety rail 10 that is relatively easy to assemble and disassemble, that is height adjustable after completely being assembled, and that is rigid, stable and designed to withstand forces of predetermined magnitudes and direction such that workers and materials are prevented from falling from an elevated floor of a building under construction to the ground below.

Referring now to FIGS. 13-16, an alternative configuration for the joined inner and outer stanchions 16 and 18 is depicted. The inner stanchion 16 includes a metal cap or cover 60 integrally joined to a second end 32 of the inner stanchion 16, the cap 60 including a centered nut 62 integrally joined to the cap 60. The outer stanchion 18 includes a metal cap or cover 64 integrally joined to a second end 44 of the outer stanchion 18, the cap 64 including a centered aperture 66 that allows a washer 68 to be disposed upon a top edge portion 70 of the aperture 66. A bolt 72 is ultimately inserted through the washer 68 and rotationally inserted into the nut 62 until the outer stanchion 18 is rigidly secured to the inner stanchion 16. In the event longer outer stanchions 18 are required to fabricate a safety rail 10, longer bolts 72 and coupling members 50 may be required to secure and stabilize the outer stanchion 18 to the inner stanchion 16.

Referring now to FIGS. 17-20, another alternative configuration for the joined inner and outer stanchions 16 and 18 is depicted. The inner stanchion 16 includes a metal cap 80 integrally joined to a second end 32 of the inner stanchion 16, the cap 80 including a centered stud 82 integrally joined to and extending upward from a top wall 81 of the cap 80. The outer stanchion 18 includes a metal cap 84 integrally joined to a second end 44 of the outer stanchion 18, the cap 84 including a centered aperture 86 that allows a washer 88 to be disposed upon a top edge portion 90 of the aperture 86. A nut 92 is rotationally secured to a threaded end 94 of the stud 82 until the outer stanchion 18 is rigidly secured to the inner stanchion 16. The ultimate length selected for the outer stanchion 18 is limited to the cooperating length of the stud 82 extending upward from the cap 80 covering the second end 32 of the inner stanchion 16.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A metal safety rail formed from multiple rail sections comprising:

a plurality of baseplates corresponding to a safety rail length formed from multiple rail sections, each one of said plurality of baseplates being separated from an adjacent baseplate a predetermined distance;

a pair of substantially vertical inner stanchions integrally joined to each one of said plurality of baseplates;

a pair of substantially vertical outer stanchions, said outer stanchions being vertically joined together via at least one guard member, thereby forming a substantially vertical rail section having said pair of outer stanchions horizontally separated a predetermined distance that allows one stanchion of said pair of outer stanchions to slide upon a cooperating inner stanchion joined to one of said plurality of baseplates, said horizontal separation allowing an opposing outer stanchion of said pair of outer stanchions to simultaneously slide upon a cooperating inner stanchion joined to a baseplate adjacent to said one of said plurality of baseplates; and means for removably securing an outer stanchion disposed upon a cooperating inner stanchion, said removable securing means including an elongate sleeve integral with and extending from an upper arcuate surface of said outer stanchion, said sleeve having a longitudinal dimension and an inner diameter that cooperate to snugly receive and longitudinally engage a corresponding portion of a joining member of said removable securing means to provide rigidity and stability to said outer stanchions after said joining member is secured to said inner stanchion, whereby a plurality of said baseplates and said inner stanchions cooperated with a plurality of said rail sections to ultimately form a safety rail disposed about a predetermined periphery.

2. The safety rail of claim 1 wherein each one of said baseplates is secured to the floor surface via mounting studs integrally joined to a floor portion.

3. The safety rail of claim 1 wherein said inner stanchion includes a pipe integrally joined to a top wall of each one of said baseplates via a collar.

4. The safety rail of claim 1 wherein said inner stanchion includes means for removably receiving said joining member that ultimately secures said outer stanchion to said inner stanchion.

5. The safety rail of claim 4 wherein said outer stanchion includes an aperture for receiving said sleeve such that said outer stanchion and said sleeve are axially aligned with said inner stanchion, said outer stanchion ultimately being secured to said inner stanchion.

6. The safety rail of claim 5 wherein said joining member includes a rod and means for securing said rod to said outer stanchion after said outer stanchion is separated from said inner stanchion.

7. The safety rail of claim 6 wherein said securing means for securing said rod to said outer stanchion includes a retaining washer integrally joined to said rod inside said outer stanchion, and a retaining nut rotationally secured to said rod outside said outer stanchion.

8. The safety rail of claim 7 wherein said retaining washer and said retaining nut are distally disposed to allow said rod to longitudinally slide within said sleeve a predetermined maximum distance that promotes insertion of said rod into a funnel member, and that prevents damage to said rod when said outer stanchion is disposed upon said inner stanchion.

9. The safety rail of claim 5 wherein said inner stanchion means for removably receiving said joining member includes a cap secured to a top portion of said inner stanchion, said cap having a centered stud extending upward from said cap.

10. The safety rail of claim 9 wherein said means for removably receiving said joining member includes a cap secured to a top portion of said outer stanchion, said cap having a centered aperture.

11. The safety rail of claim 10 wherein said joining member includes a bolt and washer, said washer disposed upon an edge portion of said aperture in said cap on said outer stanchion, said being bolt inserted through said washer and said aperture in said cap until being rotationally joined to said removable receiving means of said inner stanchion, thereby securing said outer stanchion to said inner stanchion.

12. The safety rail of claim 10 wherein said joining member includes a nut rotationally secured to a threaded portion of said stud extending upward from said cap of said inner stanchion, said centered stud extending a distance beyond a top wall of said cap of said outer stanchion a distance that allows said nut to snugly secure said outer stanchion to said inner stanchion such that movement of said outer stanchion relative to said inner stanchion is minimized.

13. The safety rail of claim 5 wherein said joining member includes a bolt having a head portion that covers a top end of said outer stanchion, said bolt having a threaded extension portion that inserts into a top portion of said outer stanchion and snugly through said sleeve such that said bolt is rotationally secured to said removable receiving means of said inner stanchion, thereby securing said outer stanchion to said inner stanchion while preventing engagement between said head portion and an upper portion of said outer stanchion.

14. The safety rail of claim 4 wherein said means for removably receiving said joining member includes a funnel member secured to a top portion of said inner stanchion.

15. The safety rail of claim 14 wherein said funnel member includes a threaded aperture for removably receiving a lower end of said joining member.

16. The inner stanchion of claim 4 wherein said means for removably receiving said joining member includes a nut secured to a top portion of said inner stanchion.

17. The inner stanchion of claim 4 wherein said means for removably receiving said joining member includes a cap secured to a top portion of said inner stanchion, said cap having a centered nut integrally joined thereto.

18. The safety rail of claim 1 wherein said inner stanchion includes a weep hole proximate to a base portion of said inner stanchion.

19. The safety rail of claim 1 wherein said outer stanchion includes a weep hole proximate to a base portion of said outer stanchion.

20. The safety rail of claim 1 wherein said guard member includes a plurality of substantially horizontal cables detachably secured to adjacent outer stanchions.

21. The safety rail of claim 1 wherein said guard member includes a plurality of substantially horizontal angle irons detachably secured to adjacent outer stanchions.

22. A reusable safety rail comprising:

a plurality of pairs of first and second inner stanchions disposed about a preselected periphery, said first and second inner stanchions being disposed together in relatively close proximately, said first and second inner stanchions being vertically secured via a first end to said preselected periphery, each pair of said plurality of pairs of first and second inner stanchions being separated from an adjacent pair of first and second inner stanchions a predetermined distance substantially equal to the length of a guard member; and a pair of substantially vertical outer stanchions, said outer stanchions being vertically joined together via at least one guard member, thereby forming a substantially vertical rail section having said pair of outer stanchions horizontally separated a predetermined distance that allows one stanchion of said pair of outer stanchions to slide upon a cooperating first inner stanchion of a first pair of inner stanchions, said horizontal separation allowing an opposing outer stanchion of said pair of outer stanchions to simultaneously slide upon a cooperating second inner stanchion of a second pair of inner stanchions, said outer stanchions ultimately being secured to corresponding inner stanchions via removable securing means, said removable securing means including a sleeve integrally joined to an upper arcuate portion of each of said outer stanchions, said sleeve having a longitudinal dimension and an inner diameter that cooperate to snugly receive and longitudinally engage a corresponding portion of a joining member of said removable securing means to provide rigidity and stability to said outer stanchions after said joining member is secured to a cooperating inner stanchion, whereby a plurality of said pairs of said first and second inner stanchions cooperate with a plurality of said pairs of said outer stanchions to form a safety rail disposed about said preselected periphery.

23. The safety rail of claim 22 wherein each one of said outer stanchions includes an aperture for receiving a sleeve such that said outer stanchion and said sleeve are axially aligned with an inner stanchion, said outer stanchions ultimately being removably secured to cooperating inner stanchions.

24. The safety rail of claim 23 wherein said joining member includes a rod that is rotationally secured to an inner stanchion, thereby securing an outer stanchion to said inner stanchion while preventing engagement between a head portion of said joining member and an upper portion of said outer stanchion.

* * * * *